United States Patent [19]

Uy

[11] Patent Number: 4,810,735

[45] Date of Patent: Mar. 7, 1989

[54] SPINNABLE DOPES AND ARTICLES THEREFROM

[75] Inventor: William C. Uy, Wilmington, Del.

[73] Assignee: E. I. Du Pont de Nemours and Company, Wilmington, Del.

[21] Appl. No.: 91,001

[22] Filed: Sep. 2, 1987

Related U.S. Application Data

[63] Continuation-in-part of Ser. No. 919,028, Oct. 15, 1986, abandoned, and a continuation-in-part of Ser. No. 33,259, Apr. 2, 1987, abandoned.

[51] Int. Cl.[4] ..... C08K 5/42; C08K 3/32; C08L 79/04; C08L 77/06

[52] U.S. Cl. ..... 524/157; 524/165; 524/417; 524/500; 524/538

[58] Field of Search ..... 524/157, 417, 105, 538, 524/500

[56] References Cited

U.S. PATENT DOCUMENTS

| | | | |
|---|---|---|---|
| 4,018,735 | 4/1977 | Nakagawa | 524/157 |
| 4,207,407 | 6/1980 | Helminiak | 525/425 |
| 4,225,700 | 9/1980 | Wolfe | 528/337 |
| 4,631,318 | 12/1986 | Hwang | 525/432 |
| 4,640,948 | 2/1987 | Rasoul | 524/157 |

OTHER PUBLICATIONS

ACS, Div. of Org. Coatings, etc. 48,929 (1982), pp. 929–93.

Polymer Eng. & Science, mid-Oct. 1983, V. 23, N14, pp. 784–788.

J. Macromol Sci.-Phys. B22(2), 231–257 (1983).

*Primary Examiner*—C. Warren Ivy

[57] ABSTRACT

Spinnable dopes of poly-p-phenylenebenzobisthiazole, poly-p-phenylenebenzobisoxazole, or poly-2,5-benzoxazole and thermoplastic or intractable polymers in certain mixed solvents are provided.

5 Claims, No Drawings

SPINNABLE DOPES AND ARTICLES THEREFROM

RELATED APPLICATIONS

This application is a continuation-in-part of my application Ser. No. 919,028 filed Oct. 15, 1986 and my application Ser. No. 033,259 filed April 2, 1987, both now abandoned.

BACKGROUND

Poly-p-phenylenebenzobisthiazole, poly-p-phenylenebenzobisoxazole and poly-2,5-benzoxazole are intractable polymers by which is meant they are non-melting but soluble. Mixtures of these polymers have been made with thermoplastic polymers to provide melt-processability. Mixtures of these polymers with other intractable polymers have been made for various purposes. Procedures for making these mixtures have been deficient since the available techniques for preparing solutions of the polymer combinations for processing have required isolation of the intractable polymer from its polymerization solvent, polyphosphoric acid, prior to preparation of the mixed polymer solution. The present invention overcomes these deficiencies.

SUMMARY OF THE INVENTION

This invention provides a spinnable quaternary dope comprising the polymer combination of a first polymer selected from poly-p-phenylenebenzobisthiazole, poly-p-phenylenebenzobisoxazole or poly-2,5-benzoxazole and a second polymer selected from a thermoplastic polymer or another intractable polymer (other than said first polymer) in the proportions of 5% to 70% by weight of the first polymer and 30% to 95% by weight of the second polymer in a solvent combination of polyphosphoric acid and methanesulfonic acid or chlorosulfonic acid, the concentration of said polymer combination in said solvent combination being at least 1 percent by weight. A method for preparing this spinnable quaternary dope and fibers therefrom are also comprehended.

DETAILED DESCRIPTION OF THE INVENTION

Poly-p-phenylenebenzobisthiazole (PBT), poly-p-phenylenebenzobisoxazole (PBO), and poly-2,5-benzoxazole (AB-PBO) are prepared in polyphosphoric acid (PPA) (see U.S. Pat. No. 4,533,693). Since they are highly intractable polymers, hence not amenable to melt-processing, efforts have been made to combine them with thermoplastic polyamides. The procedure normally followed, involves isolating the PBT, PBO or AB-PBO from the polymerization solvent and redissolving it in methanesulfonic acid at low concentrations. The thermoplastic polyamide is then added to the solution such that the total polymer concentration is under 5 percent by weight. The solution is then processed into fibers or films.

The present invention provides a novel spinnable quaternary dope and a technique for preparing it which is unobvious from and superior to the prior art procedures. It involves first preparing a solution of a thermoplastic polymer in methanesulfonic acid (MSA) or chlorosulfonic acid or an equivalent strong acid. Any of a variety of thermoplastic polymers may be used as the component which provides melt-processability. Thermoplastic polyamides are preferred. The concentration of the thermoplastic polymer in solution may range from about 0.5–20% on a weight basis, preferably 1–15%. In place of the thermoplastic polymer one may use an intractable polymer, such as poly-(2,5(6*)-benzimidazole (ABPBI).

To the solution of the thermoplastic or intractable polymer, one adds a solution of PBT, PBO or AB-PBO in the polyphosphoric acid polymerization solvent and then shear mixes the combined solutions. Preferably the PBT, PBO or AB-PBO should have an intrinsic viscosity of at least 15 dL/g as measured in MSA. The concentration of the PBT, PBO or ABO-PBO in the polyphosphoric acid should be at least 0.5 and preferably between 1 and 20 weight percent. The combined polymer concentration of the resulting quaternary solution should be at least 1% by weight and the MSA/PPA solvents ratio should range from 95/5 to 5/95 on a weight basis. The presence of PPA increases spin solution viscosity for improved spinnability. In practice, chunks of the PBT, PBO or AB-PBO in polyphosphoric acid are added to the thermoplastic polymer solution with shear mixing, preferably without applying external heating to avoid degradation of less stable thermoplastic polymer. An Atlantic Mixer is quite useful for this purpose, shearing being effected by the wall wiping mechanism. The proportions of the solutions are selected to yield the ratio of PBT, PBO or AB-PBO to thermoplastic or intractable polymer desired in the dope. It is preferred that the concentrations of both solutions be about equal so that the final concentration of total polymer in the quaternary dope remains constant while the ratio of the two solutions are varied to obtain different polymer ratios. The ratio of PPA to MSA or chlorosulfonic acid is preferably in the range of 60:40 to 30:70 on a weight percent basis. To obtain maximum benefits, the PBT, PBO or AB-PBO should constitute from 5 to 70% by weight of the polymer mixture. The second polymer should range from 30 to 95% by weight. Preferably, the polymers should be in the ratio of 60:40 to 40:60 by weight.

The present invention provides advantages of operation since the PBT, PBO or AB-PBO need not be separated from the polymerization solvent. Further, by combining the polymers as solutions an obstacle previously facing the art was removed. Thermoplastic polyamide, for example, is relatively insoluble in polyphosphoric acid at room temperature. When heating to promote dissolution in the polyphosphoric acid, it is found that there is severe degradation of the thermoplastic polyamide. Surprisingly, the solutions can be combined with shear mixing without use of the high temperatures that would degrade the thermoplastic polyamide. A further advantage is that the rheology of the resulting quaternary solution from the combined solutions is such as to permit air-gap spinning. Fibers spun from such quaternary solutions have been found to possess tensile properties that are substantially greater than those spun from ternary solutions of the same polymer combination. Novel microstructures have been observed in scanning electron micrographs of cross-sections transverse to the fiber length. Films, bars and other composite articles may be prepared by winding those composite fibers of the invention containing a thermoplastic polymer as the second polymer into a form and compression molding it with heat.

The following examples illustrate the invention and are not intended as limiting. Intrinsic viscosities were measured in MSA:

EXAMPLE 1

15 parts by weight of thermoplastic polyamide were added to 85 parts by weight of MSA in a glass jar and stirred at room temperature using a simple polytetrafluoroethylene coated magnetic stirrer. The thermoplastic polyamide employed is an amorphous copolymer of (48tt) bis(p-aminocyclohexyl)methane, isophthalic and dodecanedioic acids in a 100/60/40 mol percent basis. The solution was a brown viscous liquid. 60.5 g of the solution was poured into an Atlantic Mixer (Model No. 2CV, Capacity: 150 cc). Then 61.8 grams of a 14.5 wt. % dope of PBT (19.6 dL/g intrinsic viscosity) in PPA were added to the mixture with the mixer operating at low speed and without applying external heating. The PBT/PPA dope broke up and "dissolved" into the polyamide-MSA solution. Mixing was continued into the next day, when the mixture became homogeneous. The resulting quaternary solution or dope exhibited shear opalescence. It was stirred and deaerated under vacuum overnight. The dope was transferred to a spin cell and spun at 54° C. through a 0.25 inch air gap into an ice water bath to extract solvent. The dope was spun from a 10-hole spinneret (0.004 in holes) at 7.5 m/min. The throughput rate was 0.02 ml/min/hole. To ensure complete removal of the acid solvents, bobbins of yarn were immersed in water overnight and then air dried. The as-spun composite yarn (PBT/polyamide, 50/50 by weight or 42/58 by volume) had the following filament tensile properties (denier, tenacity, elongation, modulus) (D/T/E/M): 66 denier, 4.3 gpd, 1.4%, 344 gpd. and an orientation angle of 15°. Thermal stability was evaluated by threading the yarn through a horizontal hot tube with one end tied and a 10-gram load on the other end. The temperature was raised to 716° C. over a period of 3 hours 30 minutes at which point the yarn broke.

EXAMPLE 2

15 grams of an amorphous thermoplastic polyamide, a copolymer of hexamethylene diamine, (20tt) bis(p-aminocyclohexyl)methane, isophthalic and terephthalic acids in 96/4/70/30 mol percent basis, was dissolved in 85 grams of MSA at room temperature. 72.3 grams of the solution was mixed with 73.2 grams of the same PBT/PPA dope used in Example 1 to give PBT/polyamide weight ratio of 50/50 and MSA/PPA solvents ratio of 50/50. The mixing was done without external heat. After several hours, a homogeneous quaternary spin dope was obtained. It was shear opalescent and light metallic green. Mixing was continued to the next day when vacuum was applied to deaerate the dope. After remaining quiescent over a weekend, some phase separation took place. The dope was mixed for 2.5 hours before transferring to the spin cell. It was spun at 60° C. from a 10-hole spinneret of 0.005 in hole diameter through a 0.75 in air gap at 7.5 m/min with spin-stretch factor of 4.7 into ice water. The yarn was immersed in water for several days, then in acetone to remove any residual MSA and then air dried. The 50/50 PBT/polyamide composite fiber tensile properties (T/E/M) are: 3.7 gpd, 0.6%, 390 gpd. The same thermal stability test was made as in Example 1 and the yarn survived till 723° C. In a separate experiment, a higher PBT to polyamide ratio of 62/38 was used. The spun composite fiber had T/E/M properties of 5.7 gpd/0.82/691 gpd.

EXAMPLE 3

A solution was made using 30 grams of the polyamide of Example 1 and 170 grams of MSA. 94.2 grams of this solution were mixed with 141.3 grams of the same PBT/PPA dope used in the above examples to make a spin dope where the PBT/polyamide ratio was 60/40 by weight or 53/47 by volume and MSA/PPA ratio of 40/60. The homogeneous quaternary spin dope was heated to 60° C. to reduce viscosity for transfer to the spin cell. Yarn was spun at 75° C. through a 0.375 in air gap, at 7.5 m/min using 10-hole spinneret with 0.005 in holes. Spinning was excellent. After overnight immersion in water, the bobbin of yarn was immersed in acetone the next night to extract any residual MSA. The dried composite fiber T/E/M properties are 3 gpd/1.0%/342 gpd.

EXAMPLE 4

A spin dope of PBT and the polyamide of Example 1 at a polymer ratio of 59.2/40.8 by weight (51/49 by volume) was made using 54.3 grams of the polyamide/MSA solution of Example 3 and 81.4 grams of the same PBT/PPA dope used in the above examples. The resulting quaternary spin dope with a MSA/PPA ratio of 40/60 was mixed without external heating. On the following day, the temperature was raised to and kept at 75° C. for 1.5 hours to reduce viscosity before transfer to the spinning cell. Yarn was spun at 75° C., through a 0.5 in air gap, at 7.5 m/min using a 10-hole spinneret having 0.005 in holes. The as-spun composite fiber had T/E/M properties of 7.3 gpd/1.5%/586 gpd.

EXAMPLE 5

A quaternary spin dope containing cis-PBO and the polyamide of Example 1 in a 66/34 weight ratio (59/41 by volume) was made using 65.2 grams of 15% of the polyamide in MSA and 136.2 grams of 14.1% cis-PBO (intrinsic viscosity of 16.6 dL/g) in PPA. The mixture with a MSA/PPA ratio of 32/68 was mixed overnight under house vacuum (24 in vacuum) without applying external heat. The resulting quaternary dope was heated to 60° C. the next day to improve flowability for filling the spin cell. The dope was shear anisotropic. Yarn was spun at 60° C. through a 0.75 in air gap at 7.5 m/min using a 10-hole (0.005 in holes) spinneret. The composite fiber has the following T/E/M tensile properties: 8.4 gpd/2.2%/324 gpd. The fiber orientation angle is 17°.

EXAMPLE 6

A quaternary spin dope containing AB-PBO from 3-amino-4-hydroxybenzoic acid and the polyamide of Example 1 in 66/34 weight (60/40 volume) ratio was made using 69.5 grams of the polyamide in MSA and 139.8 grams of AB-PBO (intrinsic viscosity of 8.8 dL/g) in PPA. The AB-PBO/PPA dope viscosity was high and it could not be mixed with the polyamide/MSA solution until it was heated up to 70° C. at which time a homogeneous dope was prepared. The dope was removed from the mixer and charged into the spin cell. Yarn was spun at 70° C. through a 0.7 in air gap, and at a throughput rate of 0.02 ml/min/hole but at a windup speed of 2.0 m/min. The dried composite fiber has T/E/M tensile properties of 2.3 gpd/12.5%/36 gpd. The fiber orientation angle is 45°.

EXAMPLE 7

A quaternary spin dope consisting of 3.0 weight percent solids (60 weight percent PBT/40 weight percent) of the polyamide of Example 1, in 97 weight percent mixed solvents (50 weight percent MSA/50 weight percent PPA) was prepared from a solution of the polyamide of Example 1 at 1.35 weight percent concentration in MSA/PPA (55.9 weight percent MSA/44.1 weight percent PPA) and a dope of PBT (17.0 dL/g intrinsic viscosity) at 14.9 weight percent concentration of PPA. Preparation was as follows: 110.2 grams of MSA and 87.0 grams of PPA were mixed together in a glass jar at room temperature using a "Teflon" coated magnetic stirrer. 2.7 grams of the polyamide was added to the MSA/PPA mixed solvents and stirred at room temperature. The solution was poured into an Atlantic Mixer. Then 27.3 grams of the PBT/PPA dope were added to the Mixer while operating at slow speed under vacuum (for deaeration) without applying external heat. The PBT/PPA dope was found to gradually break up and "dissolve" into the polyamide MSA/PPA solution. The next day there were still a few chunks of PBT/PPA dope stuck at the top of the Mixer blades. The chunks of PBT/PPA dope were scraped into the rest of the spin dope, and mixing was continued into the next day when the mixture became a homogeneous phase, gel-like in consistency. The quaternary spin dope was transferred to a spin cell and air-gap spun (0.25 in air-gap) at room temperature at 12.6 meter/minute using a 10-hole spinneret with hole diameter of 0.005 in and a spin-stretch factor of 4.0 [a 10-hole spinneret with a hole diameter of 0.010 in was also used to air-gap spin (0.25 in air-gap) yarn at room temperature and 2.0, 4.0 and 6.0 meter/minute with a spin-stretch factor of 2.5, 5.0, and 7.6, respectively.] The throughput rate was 0.04 ml/min/hole. To ensure complete removal of the acid solvents, the bobbins of yarn were immersed in water (the extraction solvent) overnight and then air dried. The as-spun yarn (PBT/polyamide, 60/40 by weight or 52/48 by volume) tensile properties (denier, tenacity, elongation, modulus) are: 39 denier, 2.2 gpd, 6.3%, 113 gpd. The orientation angle measured by wide angle X-ray diffraction is 40°. The relatively low tensile properties are attributed to inadequate deaeration.

EXAMPLE 8

A quaternary spin dope consisting of 5.8 weight percent solids (60 weight percent PBT/40 weight percent ABPBI) in 94.2 weight percent solvent (79 weight percent MSA/21 weight percent PPA) was prepared from a solution of ABPBI at 3.0 weight percent concentration in MSA and the same PBT/PPA dope of Example 1. Preparation was as follows: 4.8 grams of ABPBI, poly-2,5(6)-benzimidazole (5.17 inherent viscosity) polymer, measured at 0.5 g/100 ml sulfuric acid, was added to 155.2 grams MSA in a glass jar and stirred at 60° C. using the "Teflon" coated magnetic stirrer. The solution was extremely viscous. The solution was poured into an Atlantic Mixer. Then 48.0 grams of cut up pieces of the PBT/PPA dope were added to the Mixer while operating at slow speed under vacuum (for deaeration) and 50° C. The PBT/PPA dope was found to gradually break up and "dissolve" into the ABPBI-MSA solution. Mixing was continued into the next day. The spin dope was transferred to a spin cell and air-gap spun (0.25 in air-gap) at room temperature at 12.6 meter/minute using a 10-hole spinneret with hole diameter of 0.005 in and a spin-stretch factor of 4.0 indicating that the as-spun yarn could sustain a spin-stretch. The throughput rate was 0.04 ml/min/hole. Due to the presence of many air pockets, the throughput rate was increased to 0.08 ml/min/hole, and yarn was spun at 7.5 meter/minute with a spin-stretch factor of 1.2. To ensure complete removal of the acid solvents, the bobbins of yarn were immersed in water (the extraction solvent) overnight and then air dried. The as-spun filament (PBT/ABPBI, 60/40 by weight or volume) tensile properties (denier, tenacity, elongation, modulus) are: 9.8 denier/filament, 6.2 gpd, 10.7%, 272 gpd. The orientation angle for the as-spun fiber is 31°.

EXAMPLE 9

Unidirectional test bars were prepared by winding the PBT/polyamide yarn of Example 1 around a 7 in×7 in×0.25 in plate such that the yarn was laid parallel and 3.5 layers thick. A layer of polyimide film ("Kapton"—E. I. du Pont de Nemours and Co., Inc.) coated with a mold release agent ("Frekote 33") was placed on the plate before and after the yarns were wound. Finally, a thin metal sheet was placed on each side of the structure. This whole assembly was then heated and pressed at 315° C. and 6,000 pounds (122 psi) for 15 minutes. Two (2) coherent films were obtained. 0.25 in×6.0 in strips were cut parallel to the fiber direction and 4.8 g of the strips were stacked inside an open-ended H-shaped female mold. With the male part of the mold and 0.118 in thick shims in place, pressure was applied initially at 300 lbs (200 psi), raised to a maximum of 5,400 lbs (3,600 psi) at 315° C. and released during the cool down period. The resulting bar, 0.25 in×6 in×0.113 in, has a flex strength/modulus of 42 kpsi/9.6 mpsi and short-beam-shear strength of 2.4 kpsi. A thin strip, about 0.78 mm thick, was removed from the bar. It exhibited an orientation angle of 13°.

EXAMPLE 10

A direct winding technique was also used for making unidirectional test bars. The same H-shaped mold was mounted on a rotating shaft and the PBT/polyamide yarn of Example 2 was wound into the open ended female section 0.25 in×6.0 in area on both sides of the mold. After 4.7 g grams of yarn was wound, the male section was placed on both sides of the mold and cold pressed at 5,000 pounds to compact the fiber into two bars. The exposed fiber ends at both ends of the mold were cut with a razor blade. Then the mold was opened and the two bars were stacked together and hot pressed in the mold using 0.1195 in shim thickness at 315° C. and 5,000 pounds (3,333 psi) for 20 minutes. An initial cold pressure of only 500 pounds was used, but the pressure was maintained at 6,000 pounds during cool down. Final bar dimensions were 0.1035 in×0.25 in×6 in. Measured flex strength-modulus properties are 54 kpsi/8.8 mpsi with short-beam-shear strength (SBSS) of 4.4 kpsi. A thin strip, about 0.68 mm thick, was removed from the bar. It exhibited an orientation angle of 11°.

By building successive layers of coating on a mold, followed by extraction and drying, an in situ composite of complex shape is easily prepared from the quaternary dopes. A small cylinder was prepared by coating a stainless steel rod with a dope of the invention containing 15% solids. Each coating was extracted by washing in watef and drying with a hot air gun. After application of four coats, the cylinder was consolidated using a hot air gun at 315° C.

Fibrids were made by mechanical shear precipitation of dopes of the invention (5 grams dope into 300 mls of water in a Waring blender) and small paper samples were prepared. A slurry was made by blending in a blender 0.5 gram of fibrids in 500 ml water. The slurry was filtered using a #40 filter paper in a 9-cm diameter Buchner funnel. The wet paper, about 3 in diameter, was then cold pressed at 8,000 pounds pressure. Films were produced from these papers by consolidating at 315° C. and 100 psi.

I claim:

1. A quaternary spinnable dope comprising the polymer combination of a first polymer selected from poly-p-phenylenebenzobisthiazole, poly-p-phenylenebenzo-bis-oxazole or poly-2,5-benzoxazole and a second polymer selected from a thermoplastic or intractable polymer other than said first polymer in the proportions of 5 to 70 percent by weight of the first polymer and 30 to 95 percent by weight of the second polymer in a solvent combination of polyphosphoric acid and methanesulfonic acid or chlorosulfonic acid or an equivalent strong acid, the concentration of said polymer combination in said solvent combination being at least 1 percent by weight.

2. A quaternary dope according to claim 1 wherein the second polymer is a thermoplastic polymer.

3. A quaternary dope according to claim 2 wherein the thermoplastic polymer is a polyamide.

4. A quaternary dope according to claim 1 or 2 wherein the proportions by weight of polyphosphoric acid to the methanesulfonic or chlorosulfonic acid is 40:60 to 60:40.

5. A process for preparing the quaternary dope of claim 1 comprising adding to a solution of a thermoplastic or an intractable polymer other than said first polymer in methanesulfonic acid or chlorosulfonic acid, a solution of poly-p-phenylene-benzobisthiazole: poly-p-phenylenebenzobisoxazole or poly-2,5-benzoxazole in polyphosphoric acid and shear mixing the combination.

* * * * *